US007148854B1

(12) United States Patent
Carpenter

(10) Patent No.: US 7,148,854 B1
(45) Date of Patent: Dec. 12, 2006

(54) PRECIPITATION REMOVAL APPARATUS AND METHOD

(76) Inventor: Joel A. Carpenter, 59768 Cir. 376 P.O. Box 27, Bangor, MI (US) 49013

( * ) Notice: Subject to any disclaimer, the term of this patent is extended or adjusted under 35 U.S.C. 154(b) by 0 days.

(21) Appl. No.: 11/094,041

(22) Filed: Jun. 6, 2005

(51) Int. Cl.
*H01Q 1/02* (2006.01)

(52) U.S. Cl. ..... 343/704; 343/840

(58) Field of Classification Search ..... 343/704, 343/840; 392/422
See application file for complete search history.

(56) References Cited

U.S. PATENT DOCUMENTS 2,679,003 A 5/1954 Dyke et al.
4,259,671 A * 3/1981 Levin ..... 343/704
4,866,452 A 9/1989 Barma et al.
5,729,238 A 3/1998 Walton, Jr.
5,844,526 A * 12/1998 Jones ..... 343/704
6,064,344 A 5/2000 Walton
6,084,550 A * 7/2000 Jones ..... 343/704
6,317,088 B1 * 11/2001 Lindsay et al. ..... 343/704
6,445,349 B1 9/2002 Jones

* cited by examiner

*Primary Examiner*—Hoang V. Nguyen

(57) ABSTRACT

A precipitation removal apparatus includes a satellite dish that is positioned on a mounting. An arm is attached to the mounting. A signal receptor is mounted on a post attached to the arm and is directed toward the dish. A tube is fluidly coupled to a top wall of a housing assembly, and a fan is mounted on a bottom wall of the housing assembly for directing air through an opening in the bottom wall. A heating element is mounted in the housing assembly. A bracket removably attaches the housing assembly to the arm so that the second end of the tube is directed adjacent and parallel to an outer surface of the signal receptor. The fan and heating element are turned on and warm air ejected outwardly of the tube.

4 Claims, 3 Drawing Sheets

PRECIPITATION REMOVAL APPARATUS AND METHOD

BACKGROUND OF THE INVENTION

1. Field of the Invention

The present invention relates to precipitation removal devices and more particularly pertains to a new precipitation removal device for preventing precipitation build up on a satellite signal receptor.

2. Description of the Prior Art

The use of precipitation removal devices is known in the prior art. U.S. Pat. No. 6,445,349 describes a device for heating a satellite signal receiving dish. Another type of precipitation removal device is U.S. Pat. No. 5,729,238 which also includes a device for heating a satellite dish. A similar device is found in U.S. Pat. No. 4,866,452 which includes heating elements mounted on a satellite dish for directly heating the dish.

While these devices fulfill their respective, particular objectives and requirements, the need remains for a device that is adapted for directly removing precipitation from a satellite signal receptor, as opposed to heating the entire dish. Since the signal receptor is relatively small compared to the dish, the signal receptor is more prone to being disrupted by condensation, rain and snow. For this reason, a device is needed that clears precipitation from the signal receptor.

SUMMARY OF THE INVENTION

The present invention meets the needs presented above by generally comprising a satellite dish that is positioned on a mounting. The mounting includes an arm extending forward of the dish. The arm has a bend therein so that a first portion and a second portion of the arm are defined. The first portion extends away from the dish and the second portion extends upwardly from the first portion. A post is attached to the second portion and is directed toward the dish. A signal receptor is mounted on the post and is directed toward the dish. A housing assembly includes a top wall, a bottom wall and a peripheral wall extending between the top and bottom walls. The bottom wall has an opening extending therethrough. A tube has an open first end and an open second end. The first end is fluidly coupled to the top wall. A fan is mounted on the bottom wall and is adapted for directing air into the opening in the bottom wall and outwardly of the tube. A heating element is mounted in the housing assembly. A bracket removably attaches the housing assembly to the arm so that the second end of the tube is directed adjacent and parallel to an outer surface of the signal receptor. The fan and heating element are turned on and warm air ejected outwardly of the tube.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
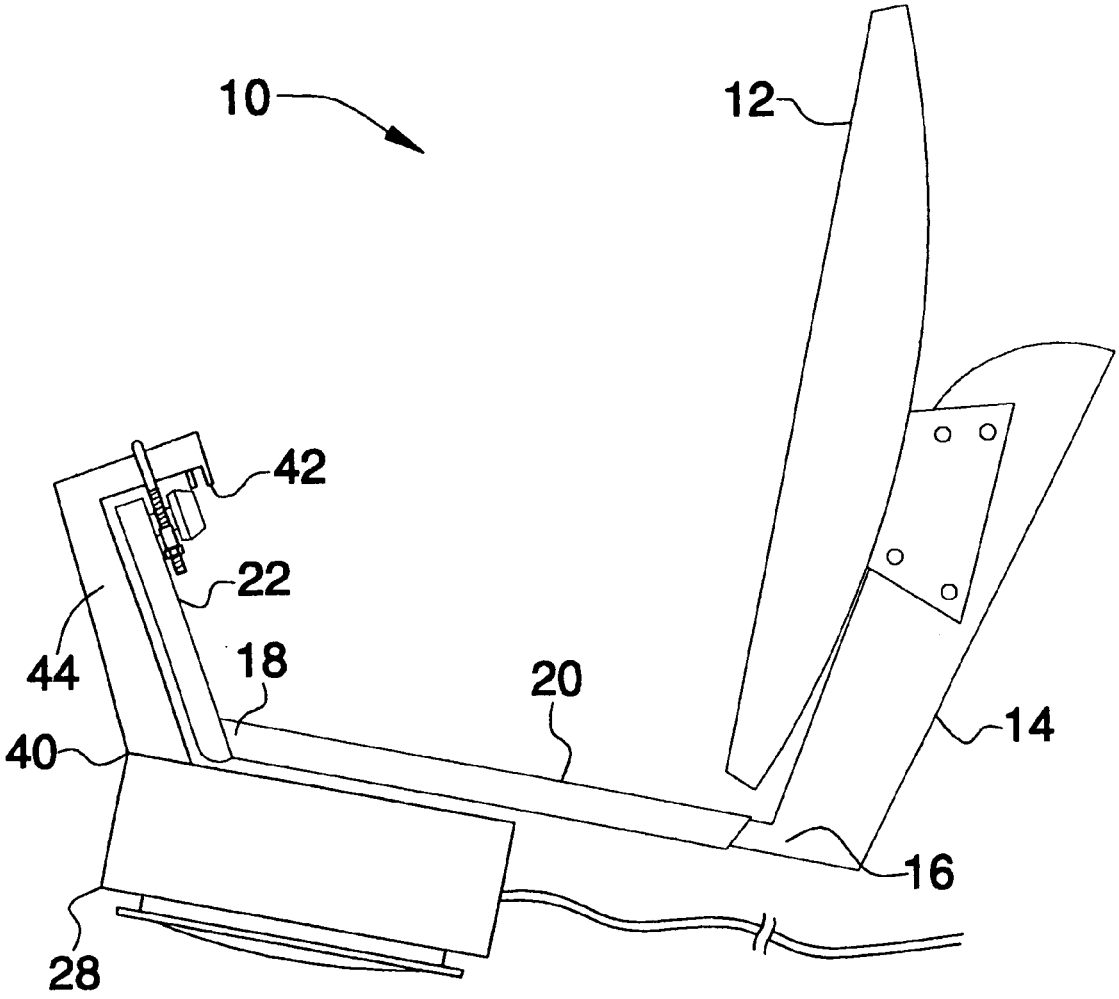
FIG. 1 is a side view of a precipitation removal apparatus and method according to the present invention.
Figure 3:
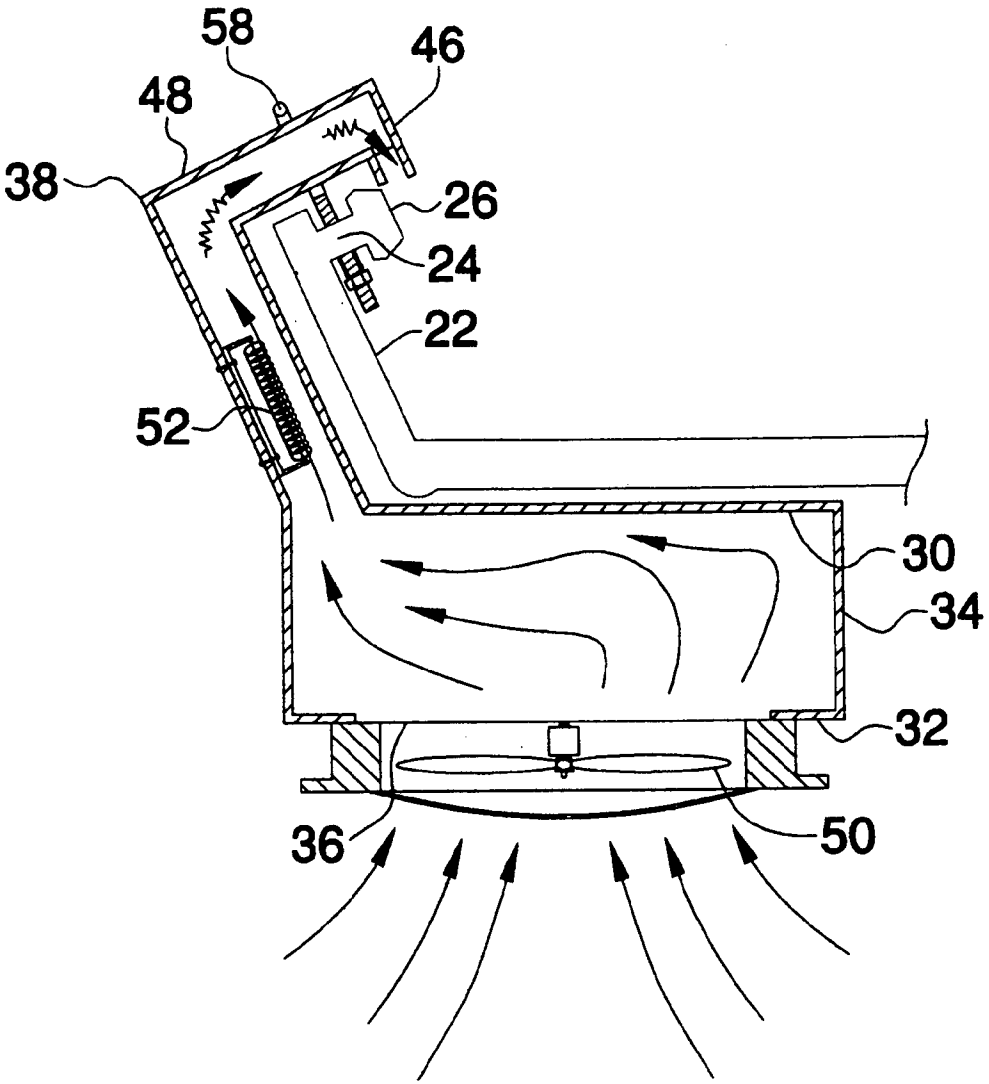
FIG. 3 is a cross-sectional view taken along line 3—3 of FIG. 2 of the present invention.
Figure 2:
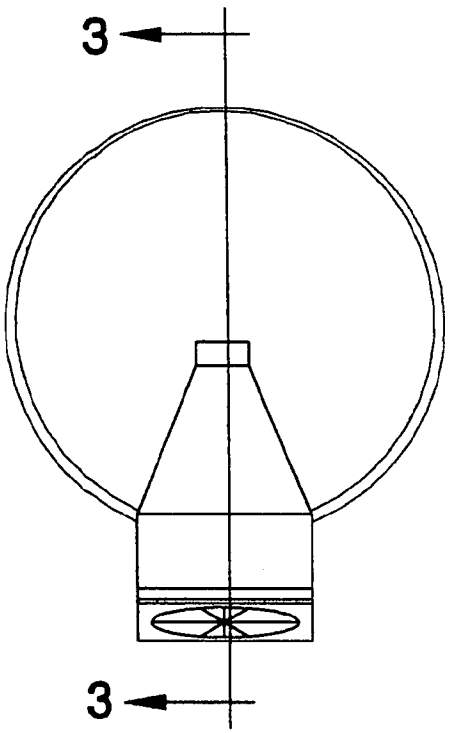
FIG. 2 is a front view of the present invention.

With reference now to the drawings, and in particular to FIGS. 1 through 5 thereof, a new precipitation removal device embodying the principles and concepts of the present invention and generally designated by the reference numeral 10 will be described.

As best illustrated in FIGS. 1 through 5, the precipitation removal apparatus and method 10 generally comprises providing a satellite dish 12 that is positioned on a mounting 14. The mounting 14 includes an arm 16 that extends forward of the dish 12. The arm 16 has a bend 18 therein so that a first portion 20 and a second portion 22 of the arm 16 are defined. The first portion 20 extends away from the dish 12 and the second portion 22 extends upwardly from the first portion 20. A post 24 is attached to the second portion 22 and is directed toward the dish 12. A signal receptor 26 is mounted on the post 24 and is directed toward the dish 12. The satellite dish 12 and mounting 14 are generally conventional.

A housing assembly 28 includes a top wall 30, a bottom wall 32 and a peripheral wall 34 extending between the top 30 and bottom 32 walls. The bottom wall 32 has an opening 36 extending therethrough. A tube 38 has an open first end 40 and an open second end 42. The first end 40 is fluidly coupled to the top wall 30 and is positioned adjacent to the peripheral wall 34. The tube 38 includes a proximal section 44 adjacent to the top wall 30, a distal section 46 adjacent to the second end 42 and a middle section 48 positioned between the proximal and 44 distal 46 sections. An angle between the proximal section 44 and the top wall 30 is generally equal to an angle between the first portion 20 and the second portion 22. The proximal section 44 has a length substantially equal to a length of the second portion 22. The middle section 48 is orientated generally perpendicular to the proximal section 44 and extends over the top wall 30. The distal section 46 and the middle section 48 are angled with respect to each other so that the second end 42 of the tube 38 is directed adjacent and parallel to an outer surface of the signal receptor 26 when the proximal section 44 is extended along the second portion 22.

A fan 50 is mounted on the bottom wall 32 and is adapted for directing air into the opening 36 in the bottom wall 32 and outwardly of the tube 38. Alternatively, the fan 50 may be positioned within the housing assembly 28. A heating element 52 is mounted in the housing assembly 28. The heating element 52 may include any conventional heating assembly typically used in conventional space heaters. A power supply 54 is electrically coupled to the heating element 52 and the fan 50. The power supply 54 preferably includes a conventional power plug. A switch 56 is operationally coupled to the power supply 54 for selectively turning the power supply on or off.

A bracket 58 is provided for removably attaching the housing assembly 28 to the arm 16. The bracket 58 is adapted for extending around the post 24 and the middle section 48. The bracket 58 may include a clevis or other U-shaped bracket wherein a rod is attachable and extended between legs of the bracket 58.

Figure 4:
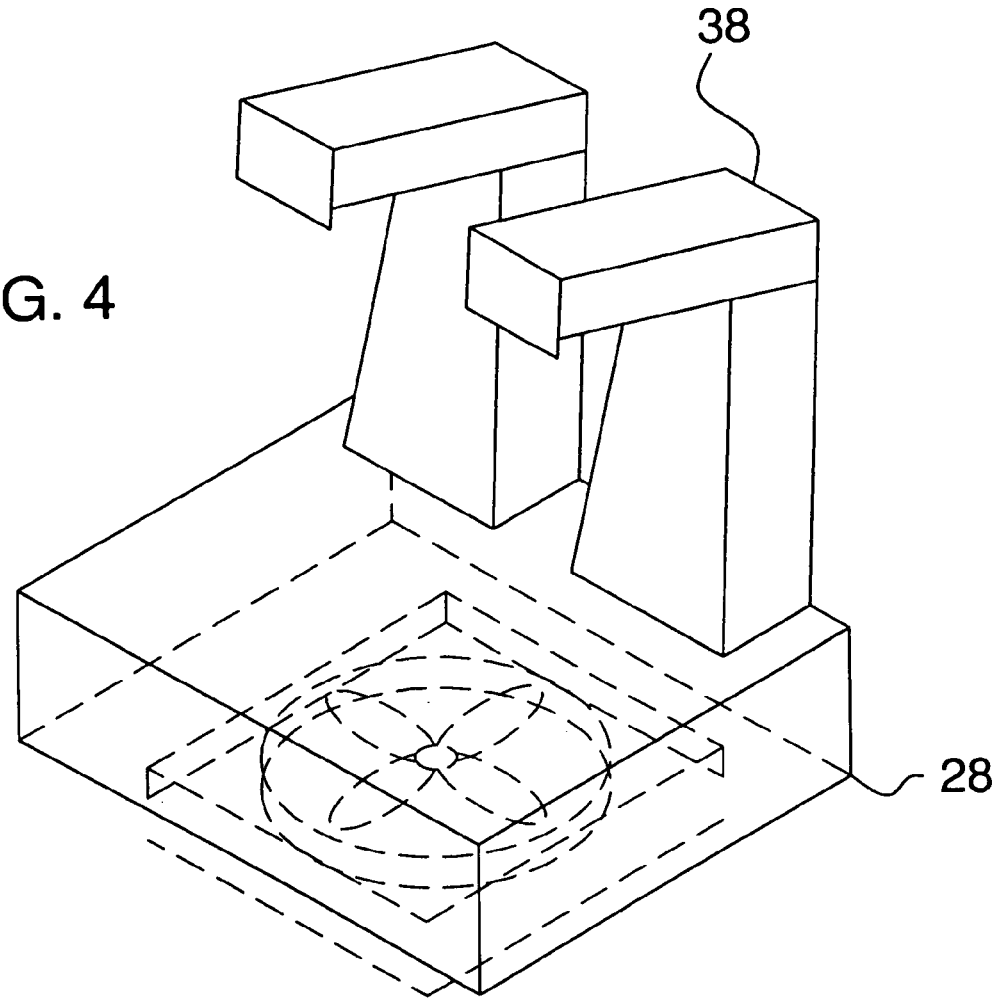
FIG. 4 is a perspective view of a second embodiment of the present invention.
Figure 5:
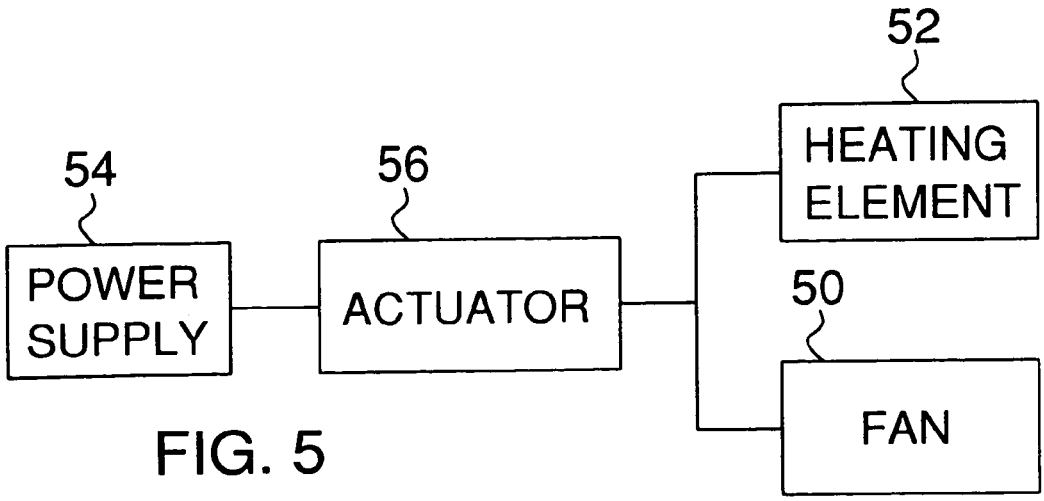
FIG. 5 is an electronic schematic view of the present invention.

In use, the housing assembly 28 is attached to the arm 16 with the bracket 58 so that the second end 42 of the tube 38 is directed adjacent and parallel to the outer surface of the signal receptor 26. The fan 50 and heating element 52 are turned on so that warm air is ejected outwardly of the tube 38. The air is blown adjacent to the signal receptor 26 but not directly thereon to prevent precipitation on signal receptor 26 without overly heating the signal receptor 26. The second end 42 of the tube 38 may be tapered to increase the velocity of the air moving outwardly of the tube 38. FIG. 4 shows a second embodiment of the housing assembly 28 for use on satellite dish systems that utilize a pair of signal receptors 26.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of clearing water away from a satellite dish signal receptor, said method comprising the steps of:

providing a satellite dish being positioned on a mounting, said mounting including an arm extending forward of said dish, said arm having a bend therein such that a first portion and a second portion of said arm are defined, said first portion extending away from said dish and said second portion extending upwardly from said first portion, a post being attached to said second portion and being directed toward said dish, a signal receptor being mounted on said post and being directed toward said dish;

providing a housing assembly including a top wall, a bottom wall and a peripheral wall extending between said top and bottom walls, said bottom wall having an opening extending therethrough, a tube having an open first end and an open second end, said first end being fluidly coupled to said top wall;

providing a fan being mounted on said bottom wall and being adapted for directing air into said opening in said bottom wall and outwardly of said tube;

providing a heating element being mounted in said housing assembly;

providing a bracket for removably attaching said housing assembly to said arm;

attaching said housing assembly with said bracket such that said second end of said tube is directed adjacent and parallel to an outer surface of said signal receptor; and turning on said fan and heating element such that warm air is ejected outwardly of said tube.

2. The method according to claim 1, wherein said tube includes a proximal section adjacent to said top wall, a distal section adjacent to said second end and a middle section positioned between said proximal and distal sections, an angle between said proximal section and said top wall being generally equal to an angle between said first portion and said second portion, said proximal section having a length substantially equal to a length of said second portion.

3. The method according to claim 2, wherein said middle section is orientated generally perpendicular to said proximal section and extends over said top wall, said distal section and said middle section being angled with respect to each other such that said second end of said tube is directed adjacent and parallel to said outer surface of said signal receptor when said proximal section is extended along said second portion.

4. A method of clearing water away from a satellite dish signal receptor, said method comprising the steps of:

providing a satellite dish being positioned on a mounting, said mounting including an arm extending forward of said dish, said arm having a bend therein such that a first portion and a second portion of said arm are defined, said first portion extending away from said dish and said second portion extending upwardly from said first portion, a post being attached to said second portion and being directed toward said dish, a signal receptor being mounted on said post and being directed toward said dish;

providing a housing assembly including a top wall, a bottom wall and a peripheral wall extending between said top and bottom walls, said bottom wall having an opening extending therethrough, a tube having an open first end and an open second end, said first end being fluidly coupled to said top wall and being positioned adjacent to said peripheral wall, said tube including a proximal section adjacent to said top wall, a distal section adjacent to said second end and a middle section positioned between said proximal and distal sections, an angle between said proximal section and said top wall being generally equal to an angle between said first portion and said second portion, said proximal section having a length substantially equal to a length of said second portion, said middle section being orientated generally perpendicular to said proximal section and extending over said top wall, said distal section and said middle section being angled with respect to each other such that said second end of said tube is directed adjacent and parallel to an outer surface of said signal receptor when said proximal section is extended along said second portion;

providing a fan being mounted on said bottom wall and being adapted for directing air into said opening in said bottom wall and outwardly of said tube;

providing a heating element being mounted in said housing assembly;

providing a bracket for removably attaching said housing assembly to said arm, said bracket being adapted for extending around said post and said middle section;

attaching said housing assembly with said bracket such that said second end of said tube is directed adjacent and parallel to an outer surface of said signal receptor; and turning on said fan and heating element such that warm air is ejected outwardly of said tube.

* * * * *